US007389990B2

(12) United States Patent
Mourad

(10) Patent No.: US 7,389,990 B2
(45) Date of Patent: Jun. 24, 2008

(54) METHOD OF PLAYING A CARD GAME INVOLVING A DEALER

(76) Inventor: Raphael Mourad, 1 Hashbury Place, Thornhill, Ontario (CA) L3T 7H4

( * ) Notice: Subject to any disclaimer, the term of this patent is extended or adjusted under 35 U.S.C. 154(b) by 353 days.

(21) Appl. No.: 11/327,143

(22) Filed: Jan. 6, 2006

(65) Prior Publication Data

US 2007/0158906 A1 Jul. 12, 2007

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12, 20
See application file for complete search history.

(56) References Cited

U.S. PATENT DOCUMENTS 5,288,081 A 2/1994 Breeding
5,685,774 A 11/1997 Webb
5,921,550 A 7/1999 Awada
5,988,643 A * 11/1999 Awada ..... 273/292
6,131,907 A 10/2000 Nucifora
6,311,979 B1 11/2001 Andrew
6,575,467 B1 6/2003 Kal
6,698,759 B2 3/2004 Webb
6,705,943 B2 * 3/2004 Awada ..... 463/13
6,817,614 B2 11/2004 Ibbertson
6,840,517 B2 1/2005 Snow
2002/0113371 A1 * 8/2002 Snow ..... 273/292
2002/0137558 A1 * 9/2002 Hartl ..... 463/11

* cited by examiner

*Primary Examiner*—Benjamin H Layno
(74) *Attorney, Agent, or Firm*—Gifford, Krass, Sprinkle, Anderson & Citkowski, P.C.

(57) ABSTRACT

A method of playing a card game involves a dealer and at least one player. Each player makes at least first and second stage wagers against a gaming house conducting the game. The first card is dealt to each player for the first stage and a payout is made to each player having a winning card according to a predetermined payout schedule or rule. A second card is dealt to each player for a second stage and then a payout is made to each player having a winning hand of two cards by comparing each hand to the payout schedule of winning two card hands. In the event that there is at least one player who has won at the second stage so as to qualify for a third stage, a third card is dealt to each player who is qualified and a payout based on the third stage wager is made to each player having a winning hand at three cards by comparing the hand to a payout schedule for a winning three card hand. The card game may also include fourth and fifth stages for qualifying players who have made additional wagers for these stages.

25 Claims, 2 Drawing Sheets

| WINNING HAND COMBINATION | STEP 1 1 CARD HAND | STEP 2 2 CARD HAND | STEP 3 3 CARD HAND | STEP 4 4 CARD HAND | STEP 5 5 CARD HAND |
|---|---|---|---|---|---|
| 8 OF SPADE, 9 OR HIGHER | 1 TO 1 | NR | NR | NR | NR |
| FLUSH | NR | 1 TO 2 | 2 TO 1 | 5 TO 2 | 3 TO 1 |
| STRAIGHT | NR | 1 TO 1 | 5 TO 1 | 6 TO 1 | 7 TO 1 |
| ONE PAIR | NR | 3 TO 1 | NR | NR | NR |
| THREE OF A KIND | NR | NR | 20 TO 1 | NR | NR |
| STRAIGHT FLUSH | NR | 4 TO 1 | 25 TO 1 | 40 TO 1 | 80 TO 1 |
| FOUR OF A KIND | NR | NR | NR | 70 TO 1 | 1 TO 1 |

FIG. 3

METHOD OF PLAYING A CARD GAME INVOLVING A DEALER

FIELD OF THE INVENTION

This invention relates to card games and in particular poker-type games which are played in two or more stages.

BACKGROUND ART

A wide variety of poker-type games are known in the gaming industry including such games played at casinos. The people who gamble at casinos can vary widely in their skill level ranging from serious poker players who may play the game for competitive, compensatory, and even professional reasons to casual gamblers who are seeking primarily entertainment as a result of game participation. Casual players seeking entertainment usually do not wish to commit a high level of concentration and mental activity to the game. It is generally felt important for casinos and other professional gaming facilities to provide games which appeal to both serious players as well as more casual players. Current poker games played in casinos or other gaming establishments with cards require the use of a banker provided by the casino, this banker usually acting as a dealer or a croupier. Generally, poker players will play against other players while the casino manages the game by means of the banker and collects a commission fee at each round of the game. Poker games that are played against the dealer or banker or against other players can be intimidating to many patrons of the casino.

In many poker games both the players' cards and a dealer's cards are dealt face down in order to prevent the passing of information from one participant to another. Passing information from the dealer to the players or among the players themselves can affect the fairness, honesty and integrity of the game.

Many current poker games require participants after they are given the chance to examine their initial set of cards to make a decision on whether or not to stay in the game or to fold and lose the initial wager. In order to make a proper decision, each player needs to know and understand the strategy and rules of the game. Casual players who are not particularly familiar with the rules of the game or players involved in a poker game that has complex rules may find it difficult to make a wise decision.

Many current poker games require the players to make a decision after each stage of the game or after each card is dealt in the round. This decision may be to withdraw the placed wager or not or to place an additional wager to stay in the card game. Many card poker games have a limit on the additional wagers that a player can place when a decision to stay in the game is made. Often the additional wager is equal to or double the wager the player has initially risked. To make a good decision, the player may need to know the following:

(a) whether or not an additional wager is possible at that stage;

(b) an understanding of the strategy of the particular game; and (c) the statistics and odds of the game for particular poker hands that may be winning hands.

In many current poker games the winner or winners of each round of the game are decided only once and on a fixed number of cards, for example three, four or five cards, with or without community cards. This can be the case even in a poker game where a partial hand is provided to each player after an initial wager and the actual hand of poker involves the potential for one, two or more cards to each player or potential community cards. Also, in most known poker games it is important for each player to know and understand the ranking of poker hands.

Some multi-staged poker games played in casinos are taught in the patent literature.

For example, U.S. Pat. No. 5,921,550 to Awada describes a stud poker game for a casino wherein a player can make three wagers against the casino. The first of the three wagers is resolved by dealing a first card face up and placing it within a first of three rectangular indicia on a playing surface. If the first card is a nine or higher, the player wins the first wager. The second of the three wagers is resolved by dealing a second card face up and placing it within a second of three card areas on the table. When the second card is a nine or higher or the first and second cards are any pair from two's to eight's, the player wins a second wager. The third of the three wagers is resolved by dealing three additional cards face up and placing them within a third card receiving area on the table, thus providing the player with a five card poker hand. Any payout to the player based on the third wager is in accordance with a payout schedule.

U.S. Pat. No. 6,575,467 to Kal describes a multi-staged poker game that can be played with a conventional deck of cards with a different wild card designated at each stage. A wager is placed and a hand of cards is dealt to each player at each stage. The cards dealt to each player in previous stages become part of that player's hand at each subsequent stage. A winning hand of cards is determined at each stage by comparing the player's hand including any wild cards to a schedule of winning card combinations and an odds schedule. In this poker-type game each player may be required to ante an additional wager after the cards are dealt at each stage as a condition for continued play within that stage and within the round. In variations of this game a community card can be part of all the players' hands of cards for a particular stage and the dealer can also be dealt a hand of cards at each stage.

Despite the existence of these prior poker games, there remains a need for a poker-style game with simplified wagering structure and dealing procedures and also a card game that has playing integrity while allowing wagering options that add to the interest of the game.

SUMMARY OF THE PRESENT DISCLOSURE

The present disclosure provides advantageous methods for playing card games that involve a dealer and, in particular, a poker-style game that can be played in a casino or other wagering establishment. The advantageous card games of the present disclosure provide games that have integrity and that can be played by players with substantial skill and experience or with very little skill or experience in the playing of games of this type. Thus, as will be apparent from the following detailed description and the appended drawings which follow, the present disclosure provides, inter alia, the following advantageous advances to the field of card game playing systems and methods:

- A poker-style game having between two and five stages or steps in a round of play and in which wagers for all stages are placed at the start of the round.
- Wagers are placed by each player on at least the first two stages of play in the round and each player has the option of placing additional wagers for subsequent stages of the round.
- At each stage of the card game, each player's hand is determined to be a winning hand or not according to a predetermined rule or a predetermined payout schedule.

At each stage of the game the card dealer deals only one card to the or each player.

According to certain embodiments of the present card games, once a round of the game has commenced, no further wagers can be made by any of the players and the players are not required to make any playing decision requiring skill at any of the three to five possible stages of the game since whether or not a particular player has won at each stage is determined according to a predetermined rule or payout schedule for a winning hand.

According to an exemplary embodiment of the present disclosure a method of playing a card game involving a dealer and at least one player includes the steps of having the or each player make at least a first stage wager and a second stage wager against a gaming house conducting the card game and dealing a first card to the or each player for a first stage of the game. Payout is then made to the or each player having a winning card according to a predetermined payout schedule or rule for determination of a winning first card. A second card is then dealt to the or each player for a second stage of the game and a payout is made to the or each player having a winning hand or two cards by comparing the or each hand to a predetermined payout schedule of winning two card hands. In the event that there is at least one player who has both won at the second stage and placed a third wager so as to qualify for a third stage of the game, a third card is dealt to the or each qualified player for the third stage of the game and a payout is made based on a third stage wager to the or each player having a winning hand of three cards by comparing the or each hand to a predetermined payout schedule of winning three card hands. In the event that there is at least one player who has both won at the third stage of a game and placed a fourth stage wager so as to qualify for a fourth stage of the game, a fourth card is dealt to the or each so qualified player for a fourth stage of the game. A payout is then made based on the fourth stage wager to the or each player having a winning hand of four cards by comparing the or each hand to a predetermined payout schedule of winning four card hands. In the event that there is at least one player who has both won at the fourth stage of the game and placed a fifth stage wager so as to qualify for the fifth stage of the game, a fifth card is dealt to the or each player so qualified for a fifth stage of the game and the payout is made based on the fifth stage wager to the or each player having a winning hand of five cards by comparing the or each hand to a predetermined payout schedule of winning five card hands.

According to one embodiment of the above described card game, the cards used in the game are from a conventional deck having four suits with thirteen cards in each suit and, in the first stage of the game, there is a single winning card according to a predetermined payout schedule or rule for the single winning card is the highest ranked card of all cards dealt in the first stage according to the payout schedule or rule.

According to one version of the above described card game, at the start of each round of the game the or each player is required to make five wagers, one for each of the five stages, or possible stages of the round.

According to further exemplary embodiments of the present disclosure, an advantageous method of playing a card game with a conventional card deck having four suits and different ranks of cards within each suit involves a dealer and at least one player. This game includes the steps of having the or each player make at least first stage and second stage wagers against a gaming house conducting the card game using the dealer. A first card is dealt to the or each player for a first stage of the game and, in the event there is only one player, dealing an additional card to the dealer or a dummy player. A first possible payout is made to the player or one of the players based on the player's or that one player's first stage wager, the player or the one player having the highest ranked of all cards dealt to the at least one player and the dealer or dummy player in the first stage according to a payout schedule or rule. A second card is then dealt to the at least one player for a second stage of the game and a second payout is made to any or each player having a winning hand of two cards by comparing the or each hand to a predetermined payout schedule of winning two card hands. The amount of the second payout is based on the size of the second stage wager made by the or each player. In the event that there is at least one player who has won at the second stage and placed a third stage wager so as to qualify for a third stage of the game, a third card is dealt to the or each qualified player for this stage of the game and a payout is made based on the third stage wager to the or each player having a winning hand of three cards by comparing the or each hand to a predetermined payout schedule of winning three card hands.

According to certain exemplary embodiments of the card game described in the preceding paragraph, provided there is at least one player who has both won the previous stage of the game and placed a wager for a particular additional stage, thereby qualifying for the particular additional stage, there can be a fourth stage and even a fifth stage of the card game with each stage involving a single card being dealt to the or each qualified player for that stage and each so qualified player receiving a payout based on his or her fourth or fifth stage wager provided the player has a winning hand of four cards (in the case of the fourth stage of the game) or a winning hand of five cards (in the case of a fifth stage of the game).

According to additional exemplary embodiments of the present disclosure, an advantageous method of playing a card game involving a dealer and at least one player has three to five stages or possible stages. This card game includes the steps of having the or each player initially make a wager for each stage and possible stage of the card game and then a first card is dealt to the or each player for a first stage of the game. A payout is made from the dealer to the or each player having a winning card according to a predetermined payout schedule or rule for determination of a winning first card. A second card is then dealt to the or each player for a second stage of the game and a payout is made to the or each player having a winning hand of two cards by comparing the or each hand to a predetermined payout schedule of winning two card hands. In the event that there is at least one player who has won at the second stage who has qualified for a third stage of the game, a third card is dealt to the or each qualified player for the third stage and a payout is made based on the third stage wager to the or each player having a winning hand of three cards by comparing the or each hand to a predetermined payout schedule of winning three card hands. In the event that the card game being played has a fourth possible stage and there is at least one player who has won at the third stage so as to qualify for the fourth possible stage of the game, a fourth card is dealt to the or each so qualified player for the fourth stage. A payout is then made based on the fourth stage wager of the or each player having a winning hand of four cards by comparing the or each hand to a predetermined payout schedule of winning four card hands. In the event that the card game being played has a fifth possible stage and there is at least one player who has won at the fourth stage so as to qualify for the fifth possible stage of the game, a fifth card is dealt to the or each player so qualified for the fifth stage and a payout is made based on the fifth stage wager of the or each player having a winning hand of five cards by comparing the or each hand to a predetermined payout schedule of winning five card hands.

These and other aspects of the disclosed card game methods will become more readily apparent to those having ordinary skill in the card games art from the following detailed description taken in conjunction with the drawings provided herewith.

BRIEF DESCRIPTION OF THE DRAWINGS

So the those having ordinary skill in the art to which the present disclosure pertains will more readily understand how to make and use the subject invention, exemplary embodiments will be described in detail hereinbelow with reference to the drawings, wherein:

FIG. 3 is a payout table or payout schedule for each stage or possible stage wherein from one card to up to five cards have been dealt to each player in the card game.

DETAILED DESCRIPTION OF EXEMPLARY EMBODIMENTS

Figure 1:
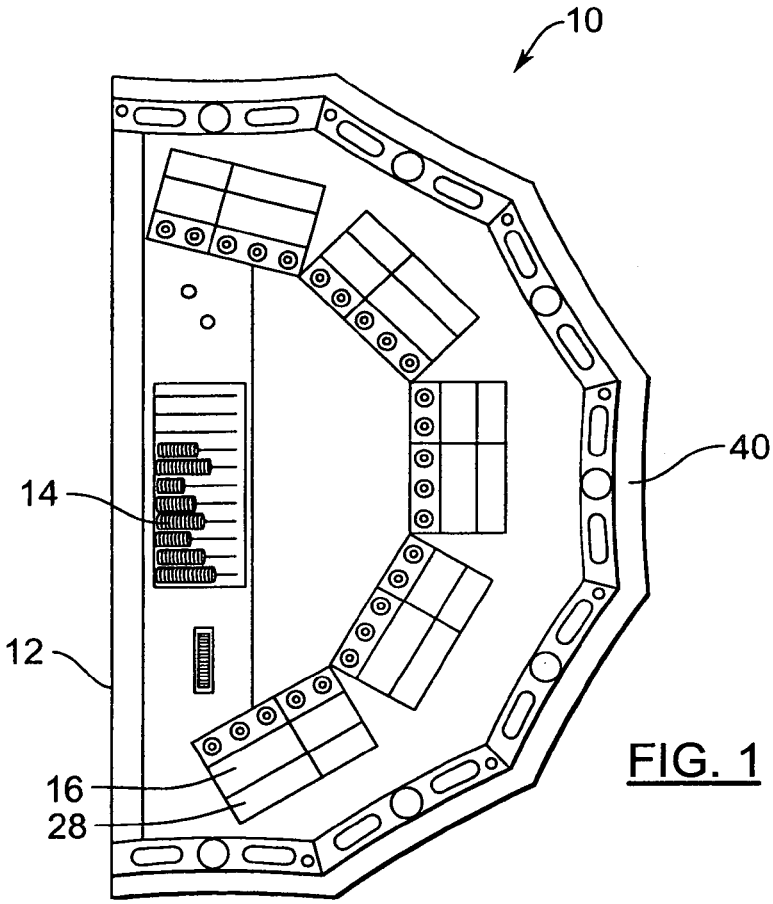
FIG. 1 is a plan view of an exemplary table playing surface for use in playing a card game according to the present disclosure.

Advantages methods of playing card games that involve a dealer and at least one player, including poker-style games are disclosed herein. These card games are fun to play for both skilled players and unskilled players and they can be suitable for use in casinos and other gaming establishments. The particularly disclosed embodiments of these games are merely illustrative of such card games that can be played according to the present disclosure. FIG. 1 illustrates a table layout or format on which a card game involving a dealer and at least one player can be played, this game having at least first and second stages during a round of the game. As shown in FIG. 1, the table layout can be generally in a semi-circular shape which is typical for a gaming table used at casinos and other commercial gaming facilities. A human dealer employed by the casino normally stands at the centre of a straight side 12 of the table layout 10. The dealer or banker is responsible for the playing chips 14 which represent the "bank" at the table and these chips 14 are used to pay out winnings to the various players of the card game. A plurality of rectangular playing areas 16 are arranged around the bank area in a generally semicircular pattern and, in the illustrated table layout, there are five of these playing areas but it will be appreciated that there could be more or fewer of these areas. The number of areas 16 is normally but not necessarily determinative of the maximum number of players that can play the card game, not including the dealer.

Figure 2:
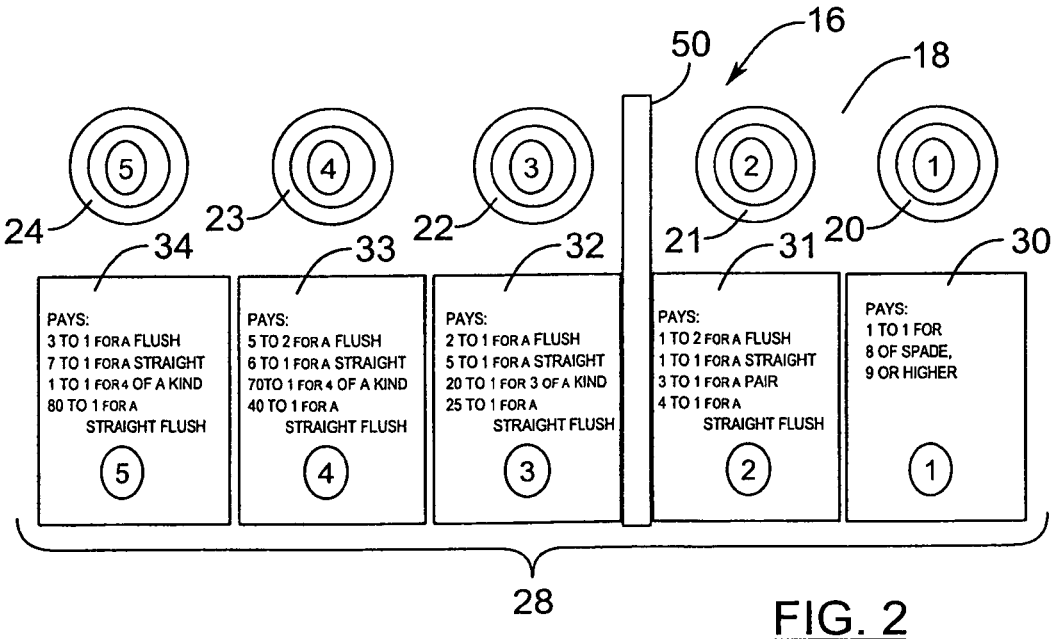
FIG. 2 is a plan view of a playing area on the table layout of FIG. 1 which is used by a single player to play a card game according to the present disclosure.

FIG. 2 illustrates an exemplary layout for one of the playing areas 16. There is a wagering section located along the top or inner portion of the area 16. This wagering section 18 can include five circular shapes, one for each of five stages or possible stages in the game. These circular shapes are indicated at 20 to 24. The areas 20 to 24 may not necessarily be circular but could be square, rectangular or any other suitable shape. As shown, the shapes or patterns 20 to 24 are labeled from 1 to 5 beginning with shape 1 on the right end of the playing area 18 and shape 5 on the left end. The shapes 20 to 24 are used to indicate the location or place on the table where that player's wager for each stage is placed or can be placed. As is well known, the wagers are normally in the form of chips representing certain monetary amounts.

It will be further understood that the number 1 on circular shape 20 on the right side can represent the location where the wager for the first stage in the round is placed. The second wager for the second stage is then placed in circular shape 21, the third wager (if any) for the player in circular shape 22, the fourth wager (if any) for the player in circular shape 23 and a fifth wager (if any) for the player in the circular shape 24.

A second section of each playing area 18 is indicated at 28 and the second section is located radially, outwardly from the position of the dealer and the bank chips 14 and closer to the player using that particular area 18. This second section can provide five payout schedules or tables in rectangles numbered from 1 to 5. These five schedules are located in rectangular areas identified by references 30 to 34. Each of these payout schedules indicates in clear text and numbers what constitutes a winning hand or winning hands of card combinations and the payout odds associated with each winning hand card combination. The rectangular areas 30 to 34 are the locations where the cards are placed during the course of a round. In one exemplary version, the size of each rectangle 30 to 34 corresponds closely to the size of conventional playing cards. If desired, a divider or dividing line can be provided at 50 to separate the areas for the first two stages (which are mandatory) from the areas for optional stages three to five.

As indicated the dealer stands or is positioned behind the bank's chips 14 and he manages these chips during the play of the card game. The dealer can deal cards from a single deck (which can be done by means of a "shoe" which is not shown but which is standard equipment in a casino). Before dealing the cards, the cards can be shuffled by a shuffler or by hand. The cards used are from a conventional deck having four suits of 13 cards in each suit. The players stand or sit along a semi-circular or multi-sided edge of the table layout 10 and each generally aligns himself or herself with a respective playing area 18 prior to the commencement of the game. It will be appreciated that there are various versions of card games that can be played according to the present disclosure and in particular games or variations of games described hereinafter are merely illustrative of such card games.

The card game can commence with players in the game making at least a first stage wager and a second stage wager against a gaming house or a casino conducting the card game. According to one exemplary embodiment of the game, each player then can make optional wagers for each of a possible third stage, a possible fourth stage, and a possible fifth stage of the game. In the alternative, other embodiments of the card game require mandatory initial wagers not only for the first and second stages but also for the third, fourth and fifth stages or possible stages of the game. Although in most exemplary embodiments of the present card games do not permit any wagers to be placed after these initial wagers have been made, it is certainly possible that variations of the present card games could allow additional wagering to be made after the first and second stages of the game have been played, for example, prior to the third stage being played, prior to the fourth stage being played, and prior to the fifth stage, if any.

After the initial wagers have been made by each player, the dealer then deals a first card to each player for a first stage of the game and this card can be dealt face up to each player. As indicated this first card can be placed on the rectangle labeled 1, that is the rectangular area 30 in FIG. 2. Payout is then made by the dealer to each player having a winning card according to a predetermined payout schedule or rule for determination of a winning first card. In a casino, the dealer can collect a commission from the winner or winners. According to exemplary versions of the present card game, the winning first card can be the highest ranked card of all cards dealt in the first stage according to the payout schedule or rule of the game for ranking the cards. According to one version of the game, the cards are ranked in the same manner as in the game of bridge with the ace being the highest card in the suit and a 2 card being the lowest. In the case of two players of the game having a card of the same level, for example, both players having a queen, then the highest of these two cards is determined according to their suit ranking in the game of bridge, for example, in bridge the suit rankings from the lowest suit to the highest suit are clubs, diamonds, hearts, and spades.

An alternative payout rule for the first stage wherein only one card has been dealt to each player can provide, for example, that any player having a nine or higher card or having an eight of spades is a winner with a payout of one to one. It will be readily apparent to those skilled in the playing of cards that a variety of different rules are possible in order to determine the winner or winners at the first stage in the game. Generally, in a game intended for play in a casino, the odds of winning would be slightly less than 50-50 in order to favor the casino.

After the first stage has been completed and the necessary payouts have been made to the winning players or player of the first stage, a second card is then dealt by the dealer to the or each player for the second stage of the game. Normally this card is also dealt face up to each player and can be placed on rectangle number 2 (which is rectangular area 31 in FIG. 2). The dealer then makes a payout to the or each player having a winning hand of two cards by comparing each hand to a predetermined payout schedule of winning two card hands. The wagers on the second stage which have not won according to the schedule are collected by the dealer. One exemplary form of payout schedule for a two card hand is set out in the following Table 1.

TABLE 1

| WINNING OUTCOME | PAYOUT |
|---|---|
| FLUSH | 1 to 2 |
| STRAIGHT | 1 to 1 |
| A PAIR | 3 to 1 |
| STRAIGHT FLUSH | 4 to 1 |

If no player has won at the second stage of the game, then all cards of all players are collected and a new round of the card game can commence. If one or more players has placed a wager for a third and possibly subsequent stages of the game but no such player has won at the second stage of the game then all wagers placed by any such players for a possible third, fourth and fifth stage of the game are returned to the respective player who has made the wager or wagers. It might be noted here that players must place wagers in numerical order at the start of a round. In other words, they cannot skip a stage in the wagering although they are not necessarily required to wager on all stages in exemplary versions of the game.

After the second stage of the game has been completed and in the event that there is at least one player who has won at the second stage so as to qualify for a third stage of the game and who has made a third stage wager at the beginning of the round, a third card is then dealt by the dealer to the or each player qualified for the third stage of the game. The third card can be dealt either face up or face down at the player's choice and it is placed on the rectangle numbered "3" on the table, that is rectangular area 32 in FIG. 2. Once the player has chosen to receive the card face down, each such player is given the opportunity to examine his or her third card as well as the combination of three cards that that player now has. The third card is then turned face up so that there are three face up cards on each of rectangles 1 to 3. The dealer then resolves each player's three card hand according to a predetermined hierarchy of outcomes and makes the payout based on a third stage wager of each player having a winning hand of three cards. In other words, the player's hand is compared to a predetermined payout schedule of winning three card hands. An exemplary payout schedule for a three card hand is set out in Table 2 below.

TABLE 2

| WINNING OUTCOME | PAYOUT |
|---|---|
| FLUSH | 2 to 1 |
| STRAIGHT | 5 to 1 |
| THREE OF A KIND | 20 to 1 |
| STRAIGHT FLUSH | 25 to 1 |

The wagers of players who do not have a winning hand are then collected by the dealer and then the cards of losing hands are also collected. In addition, the cards of winning players who have not placed a wager on the fourth stage of the game (assuming that the card game will allow for a fourth stage) are also collected. If there is at least one winning player at the third stage who has also placed a wager for a fourth stage of the game, then the round will continue to a fourth stage if the rules for the card game so provide. If one or more players has placed a wager for a fourth or subsequent stage of the game but no such player has won at the third stage of the game, then all wagers placed by any such players are returned to the respective player who has made the wager or wagers.

In the event that the exemplary game being played has a fourth stage and at least one player who has both won at the third stage of the game and placed a fourth stage wager so as to qualify for the fourth stage of the game, a fourth card is dealt to each so qualified player by the dealer. Again, this fourth card can be dealt either face up or face down at the player's choice and it is placed on rectangle numbered 4 in the playing area in front of the player, that is the rectangular area 33 in FIG. 2. Again, each player who has received a fourth card face down is given the chance to examine this fourth card as well as the combination of four cards that he or she now has. Each of the players in the fourth stage then places his or her card face up on the rectangle numbered 4 so that all four of his or her cards are face up on the rectangles 1 to 4 and the dealer then resolves each player's four card hand according to a predetermined hierarchy of outcomes. The dealer makes a payout based on a fourth stage wager to each player having a winning hand of four cards by comparing the hand to a predetermined payout schedule of winning four card hands. In the case of non-winning hands the losing wagers for the fourth stage are collected by the dealer. An exemplary payout schedule for winning hands of four cards is set out below in Table 3.

TABLE 3

| WINNING OUTCOME | PAYOUT |
|---|---|
| FLUSH | 5 to 2 |
| STRAIGHT | 6 to 1 |
| STRAIGHT FLUSH | 40 to 1 |
| FOUR OF A KIND | 70 to 1 |

The cards of losing hands at the fourth stage and the cards of players who have winning hands that have not placed a wager for a fifth stage of the game are then collected by the dealer. Any fifth stage wagers of players who did not win at the fourth stage are pushed or given back to those players and the round then proceeds to the fifth stage if there has been at least one winning player at the fourth stage and the winning player or players have placed fifth stage wagers. At this time, the four cards of players who have won at the fourth stage are face up on the playing surface of the table.

In the event that the exemplary card game being played provides for a fifth stage of the game and provided there is at least one player who has both won at the fourth stage and placed a fifth stage wager so as to qualify for a fifth stage of the game, a fifth card is then dealt by the dealer to each player so qualified for the fifth stage. The fifth card can be dealt either face up or face down at the player's choice and this fifth card is placed on the rectangle numbered 5, which is the rectangular area 34 in the version of FIG. 2. Each player receiving a fifth card face down is given the opportunity to examine that fifth card and to consider the combination of five cards that he or she now has. Then all five cards are arranged face up on the rectangles numbered 1 to 5 in the front of each player who remains in the game. The dealer resolves each of the player's five card hands according to a predetermined hierarchy of outcomes. The dealer make a payout based on the fifth stage wager to each player having a winning hand of five cards by comparing each hand to a predetermined payout schedule of winning five card hands. Table 4 set out below provides an exemplary payout schedule for such a hand.

TABLE 4

| WINNING OUTCOME | PAYOUT |
|---|---|
| FOUR OF A KIND | 1 to 1 |
| FLUSH | 3 to 1 |
| STRAIGHT | 7 to 1 |
| STRAIGHT FLUSH | 80 to 1 |

Any wagers made by non-winning players at the fifth stage are collected by the dealer and at this final stage of the round all cards are collected so that a new round can begin.

Shown in FIG. 3 of the drawings is an exemplary payout schedule for each of the five stages or steps in a card game that include five stages or possible stages. In this table the letters "NR" indicate that the winning hand combination in the left side column is not relevant to that particular stage or step. As indicated above, instead of the winning hand combination shown in FIG. 3, for step 1 of the game, it is possible in the alternative to have a single winning card in the first step of the game, namely the highest ranked card.

Although exemplary versions of a card game according to the present disclosure can provide for a minimum of two wagers by each player, these wagers being for the first stage and the second stage of the game, other exemplary versions of the card game can provide that at the start of each round of a game, each participating player is required to make five wagers, one for each of the five stages or possible stages of the round. Requiring the players to make these five wagers at the beginning of the round can benefit the players as it can be better for the majority of players which can include both skilled and unskilled poker players.

Exemplary versions of a game of this disclosure can have a variety of rules with respect to the wagers that can be made by each player. In particular the game rules can provide that the amount of each wager made by each player can vary between the stages of a game being played or they can provide that the wager for each of the two to five stages of a round must be the same. Similarly, the amount of each wager made by each player at each stage can vary between the players participating in each round, or, in the alternative, all participating players can be required to make the same wager at each stage of the round. In the case of the first stage wager, the winning of which depends on the first card received by each player, if the card game rules provide for different bets by the players, then a payout schedule can provide that each winning player can only win the amount that has been bet, that is a one to one payout. In an alternative payout schedule for the first stage, particularly one which provides for a single winner at that stage, the payout rule can provide that the single winner can only win up to a maximum of what the other player or players in the round have bet on the first stage and cannot exceed the single winner's wager.

While it is possible for embodiments of the card games of this disclosure to provide for one or more wild cards, that is cards that can be assigned any value or suit desired by the player, many exemplary embodiments of the present card games are played with no wild cards and are played with a conventional deck having the usual four suits of 13 cards in each suit.

As indicated above and by Table 3, the predetermined payout schedule for winning two card hands can provide in exemplary versions of the card games a plurality of different winning hands based on recognized poker combinations including a flush (two cards of the same suit) and a straight (two cards where the value of one card is just above the value of the other card). In the exemplary version of a payout schedule shown in FIG. 3 the winning hands which are poker combinations include a flush, a straight, a pair, and a straight flush. The payout odds can vary depending upon the type of winning hand obtained. For example, as indicated in FIG. 3 a two card combination which comprises a pair provides an immediate payout to the winner of 3 to 1. Similarly, as indicated above and by FIG. 3, the predetermined payout schedule of winning three card hands can provide for a plurality of different winning hands based on recognized poker combinations including a flush and a straight. In the exemplary payout schedule of FIG. 3, winning three card combinations include a flush, a straight, three of a kind, and a straight flush. It should also be noted that the payout odds for winning poker combinations is substantially higher for the third stage compared to the payout odds for corresponding winning poker combinations at the second stage. For example, while a two card straight has payout odds of 1 to 1, a three card straight (which is of course harder to obtain) has payout odds of 5 to 1.

Although it is possible to play card games according to this disclosure when only a dealer and a single player are involved, some exemplary embodiments of card games according to this disclosure have at least two players in addition to the dealer. It will be appreciated that if a winning player at the first stage of the game is to be a player which holds the highest ranking card of all cards held by players (as opposed to the dealer or a dummy player), then there must be at least two players whose first cards can be compared by the dealer. Of course, as indicated above, alternative rules can be provided for determining the winner or winners of the first stage of the game, for example, see the winning hand combination indicated in FIG. 3 for step 1. Also though, many exemplary versions of the card games of this disclosure provide for the possibility of each round having five stages, other exemplary versions of the card game can provide for only three stages or possible stages in each round or only four stages or possible stages in each round.

If there are at least two stages in each round and provision for a possible third stage, then the rules of play can provide that each player initially make a wager for each stage or possible stage of the card game, that is three wagers. The same rules can apply for a card game having at least two stages and provision for at least two further possible stages, in which case each player can be required to place four wagers at the beginning of the round.

It will also be noted that according to exemplary embodiments of the card games of this disclosure, once a player has lost at the second stage or at a subsequent stage, if that player has made wagers for the subsequent stages of the game in which he or she cannot participate, these wagers on the subsequent stages are off and are returned to that player. In addition, it will be apparent to those skilled in card games, particularly those played in casinos, that the casino can have table limits for wagers made on each round by the players. These limits can be the same for each stage of the game or they can vary depending upon the stage of the game.

While the present invention has been illustrated and described as embodied in various exemplary embodiments, it is to be understood that the present invention is not limited to the details shown in the drawings set forth above, since it will be understood that various omissions, modifications, substitutions and changes in the forms and details of the disclosed methods and their operation may be made by those skilled in the art without departing in any way from the spirit and scope of the present invention. For example, those of ordinary skill in the art will readily adapt the present disclosure for various other applications without departing from the spirit or scope of the present invention.

The invention claimed is:

1. A method of playing a card game involving a dealer and at least one player, said game comprising the steps of:

having the or each player make at least a first stage wager and a second stage wager against a gaming house conducting the card game;

dealing a first card to the or each player for a first stage of the game;

making a payment to the or each player having a winning card according to a predetermined payout schedule or rule for determination of a winning first card;

dealing a second card to the or each player for a second stage of the game, said first card and said second card forming a hand of only two cards;

making a payment to the or each player having a winning hand of two cards by comparing the or each two card hand to a predetermined payout schedule of winning two card hands;

in the event that there is at least one player who has won at the second stage and placed a third wager so as to qualify for a third stage of the game, dealing a third card to the or each qualified player for the third stage of the game, said first card, said second card and said third card forming a hand of only three cards;

making a payment based on the third stage wager to the or each player having a winning hand of three cards by comparing the or each three card hand to a predetermined payment schedule of winning three card hands;

in the event that there is at least one player who has both won at the third stage of the game and placed a fourth stage wager so as to qualify for a fourth stage of the game, dealing a fourth card to the or each so qualified player for a fourth stage of the game; said first card, said second card, said third card and said fourth card forming a hand of only four cards;

making a payment based on said fourth stage wager to the or each player having a winning hand of four cards by comparing the or each four card hand to a predetermined payment schedule of winning four card hands;

in the event that there is at least one player who has both won at the fourth stage of the game and placed a fifth stage wager so as to qualify for a fifth stage of the game, dealing a fifth card to the or each player so qualified for a fifth stage of the game, said first card, said second card, said third card, said fourth card and said fifth card forming a hand of only five cards; and making a payment based on said fifth stage wager to the or each player having a winning hand of five cards by comparing the or each five card hand to a predetermined payment schedule of winning five card hands.

2. A method of playing a card game according to claim 1 wherein the cards used in the game are from a conventional deck having four suits with thirteen cards in each suit and, in the first stage of the game, there is a single winning card according to the predetermined payment schedule or rule, said single winning card being a highest ranked card of all cards dealt in the first stage according to the payment schedule or rule.

3. A method of playing a card game according to claim 1 wherein at the start of each round of the card game the or each player is required to make five wagers, one for each of the five definite and possible stages of the round.

4. A method of playing a card game according to claim 1 wherein the amount of each wager made by the or each player can vary both with respect to the other wagers made by the respective player and with respect to the wagers made by the other player or players, if any, in the card game.

5. A method of playing a card game according to claim 1 wherein the cards used in the game are from a conventional deck having four suits with thirteen cards in each suit and none of the cards in the game are wild cards.

6. A method of playing a card game according to claim 1 wherein at least the first and second cards dealt to the or each player are dealt face up.

7. A method of playing a card game according to claim 1 wherein said predetermined schedule of winning card hands provides for a plurality of different winning hands based on recognized poker combinations including a flush and a straight.

8. A method of playing a card game according to claim 7 wherein said predetermined payout schedule of winning three card hands provides for a plurality of different winning hands based on recognized poker combinations including a flush and a straight, the payment for each winning poker combination being substantially higher for said third stage compared to the payment for a corresponding winning poker combination in the second stage.

9. A method of playing a card game according to claim 1 wherein the or each player who does not have a winning hand of two cards has any wager made by him or her beyond the first and second wagers returned to him or her.

10. A method of playing a card game according to claim 1 wherein at the start of each round of the game each player is required to make said third, fourth and said fifth stage wagers in addition to said first and second stage wagers and wherein winning the third stage wager requires the or each player to obtain said winning hand of three cards, winning the fourth stage wager requires the or each player to obtain said winning hand of four cards, and winning the fifth stage wager requires the or each player to obtain said winning hand of five cards.

11. A method of playing a card game according to claim 1 wherein the or each player at the third stage of the game who does not have a winning hand of three cards has any wager made by him or her beyond the third stage wager returned to him or her and the or each player at the fourth stage who does not have a winning hand of four cards has any fifth stage wager returned to him or her.

12. A method of playing a card game according to claim 1 wherein the cards used in the game are from a conventional deck having four suits with thirteen cards in each suit and, in the first stage of the game the predetermined payment schedule at least provides for a winning hand for the or any player having a card at least as high as a designated card number.

13. A method of playing a card game with a conventional card deck having four suits and different ranking cards within each suit, said game involving a dealer and at least one player, said game comprising the steps of:

having the or each player make at least first stage and second stage wagers against a gaming house conducting the card game using said dealer;

dealing a first card to the or each player for a first stage of the game and, in the event there is only one player, dealing an additional card to the dealer or a dummy player;

making a possible first payout to the player or one of said players based on said player's or said one player's first stage wager, the player or said one player having the highest ranked card of all cards dealt to said at least one player and the dealer or dummy player in the first stage according to a payout schedule or rule;

dealing a second card to said at least one player for a second stage of the game, said first card and said second card forming a hand of only two cards;

making a second payout to any or each player having a winning hand of two cards by comparing the or each two card hand to a predetermined payout schedule of winning two card hands, said second payout being based on the second stage wager made by the or each player;

in the event that there is at least one player who has won at the second stage and placed a third stage wager so as to qualify for a third stage of the game, dealing a third card to the or each qualified player for the third stage of the game, said first card, said second card and said third card forming a hand of only three cards; and making a payout based on the third stage wager to the or each player having a winning hand of three cards by comparing the or each three card hand to a predetermined payout schedule of winning three card hands.

14. A method of playing a card game according to claim 13 wherein provided there is at least one player who has both won at the third stage of the game and placed a fourth stage wager, thereby qualifying for a fourth stage of the game, dealing a fourth card to the or each so qualified player for the fourth stage of the game and making a payout based on said fourth stage wager to the or each player having a winning hand of four cards by comparing the or each hand to a predetermined payout schedule of winning four card hands.

15. A method of playing a card game according to claim 14 wherein, provided there is at least one player who has both won at the fourth stage of the game and placed a fifth stage wager, thereby qualifying for a fifth stage of the game, dealing a fifth card to the or each player qualifying for the fifth stage and making a payout based on said fifth stage wager to the or each player having a winning hand of five cards by comparing the or each hand to a predetermined payout schedule of winning five card hands.

16. A method of playing a card game according to claim 15 wherein at the start of each round of the card game, the at least one player is required to make three wagers for possible third, fourth and fifth stages of the game in addition to said first and second stage wagers.

17. A method of playing a card game according to claim 15 wherein none of the cards in the game are wild cards.

18. A method of playing a card game according to claim 13 wherein the amount of each wager made by the or each player can vary with respect to any other wager made by the respective player and, in the event there is more than one player in the card game, with respect to the wagers made by the other player or players in the card game.

19. A method of playing a card game according to claim 13 wherein said predetermined payout schedule of winning two curd hands provides for a plurality of different winning hands based on recognized poker combinations including a flush and a straight.

20. A method of playing a card game according to claim 19 wherein said predetermined payment schedule of winning three curd hands provides for a plurality of different winning hands based on recognized poker combinations including a flush and a straight, the payout for each winning poker combination being substantially higher for said third stage compared to the payout for a corresponding winning poker combination in the second stage.

21. A method of playing a curd game involving a dealer and at least one player and having three to five stages or possible stages, said game comprising the steps of:

having the or each player initially make a wager for each stage and possible stage of the card game;

dealing a first card to the or each player for a first stage of the game;

making a payout from the dealer to the or each player having a winning card according to a predetermined payout schedule or rule for determination of a winning first card;

dealing a second card to the or each player for a second stage of the game, said first card and said second card forming a hand of only two cards;

making a payout to the or each player having a winning hand of two cards by comparing the or each two card hand to a predetermined payout schedule of winning two card hands;

in the event that there is at least one player who has won at the second stage so as to qualify for a third stage of the game, dealing a third card to the or each qualified player for the third stage of the game, said first card, said second card and said third card forming a hand of only three cards;

making a payout based on the third stage wager to the or each player having a winning hand of three cards by comparing the or each three card hand to a predetermined payout schedule of winning three card hands;

in the event that the card game being played has a fourth possible stage and there is at least one player who has won at the third stage so as to qualify for the fourth possible stage of the game, dealing a fourth card to the or each so qualified player for a fourth stage of the game, said first card, said second card, said third card and said fourth card forming a hand of only four cards;

making a payout based on said fourth stage wager to the or each player having a winning hand of four cards by comparing the or each four card hand to a predetermined payout schedule of winning four card hands;

in the event that the card game being played has a fifth possible stage and there is at least one player who has won at the fourth stage so as to qualify for the fifth possible stage of the game, dealing a fifth card to the or each player so qualified for a fifth stage of the game, said first card, said second card, said third card, said fourth card and said fifth card forming a hand of only five cards; and making a payout based on said fifth stage wager to the or each player having a winning hand of five cards by comparing the or each five card hand to a predetermined payout schedule of winning five card hands.

22. A method of playing a card game according to claim 21 wherein the cards used in the game are from a conventional deck having four suits with thirteen cards in each suit and, in the first stage of the game, there is a single winning card according to the predetermined payment schedule or rule, said single winning card being a highest ranked card of all cards dealt in the first stage according to the payout schedule or rule.

23. A method of playing a card game according to claim 21 wherein said game has at least first and second stages and three possible subsequent stages and, at the start of each round of the card game, the or each player is required to make five wagers, one wager for each stage and possible stage.

24. A method of playing a card game according to claim 21 wherein the amount of each wager made by the or each player can vary both with respect to the other wagers made by the respective player and with respect to the wagers made by the other player or players, if any, in the card game.

25. A method of playing a card game according to claim 21 wherein the cards used in the game are from a conventional card deck having four suits with thirteen cards in each suit and, in the first stage of the game, the predetermined payout schedule at least provides for a winning hand for the or any player having a card at least as high as a designated card number.

* * * * *